United States Patent [19]

Singh

[11] 4,076,360

[45] Feb. 28, 1978

[54] SAFETY DEVICE FOR ELECTRICAL CONNECTOR DEVICE

[75] Inventor: Dharam Dev Singh, Clearwater, Canada

[73] Assignee: The Raymond Lee Organization, Inc., New York, N.Y. ; a part interest

[21] Appl. No.: 481,676

[22] Filed: Jun. 21, 1974

[51] Int. Cl.[2] ..... H01R 13/44

[52] U.S. Cl. ..... 339/36

[58] Field of Search ..... 339/36, 39, 75 P, 89, 339/199

[56] References Cited

U.S. PATENT DOCUMENTS

| | | | |
|---|---|---|---|
| 1,539,539 | 5/1925 | Benjamin | 339/89 C |
| 2,037,907 | 4/1936 | Johnson | 339/89 R |
| 2,559,151 | 7/1951 | Getzoff | 339/36 |
| 2,716,225 | 8/1955 | McCubbin | 339/75 P |
| 3,601,757 | 8/1971 | Gober | 339/39 |
| 3,656,083 | 4/1972 | Brook | 339/39 |

FOREIGN PATENT DOCUMENTS

| | | | |
|---|---|---|---|
| 19,344 of | 1915 | United Kingdom | 339/89 M |

*Primary Examiner*—Joseph H. McGlynn
*Attorney, Agent, or Firm*—Daniel Jay Tick

[57] ABSTRACT

An externally threaded sleeve type device surrounds at least part of an electrical connector device. An internally threaded cap is threadedly coupled to the sleeve type device and covers the electrical connector device.

4 Claims, 5 Drawing Figures

SAFETY DEVICE FOR ELECTRICAL CONNECTOR DEVICE

DESCRIPTION OF THE INVENTION

The present invention relates to a safety device for an electrical connector device, which safety device is of simple structure, inexpensive in manufacture and protects people, and especially children, from electrical shock with efficiency, effectiveness and reliability.

In order that the invention may be readily carried into effect, it will now be described with reference to the accompanying drawing, wherein.

In the FIGS., the same components are identified by the same reference numerals.

Figure 1:
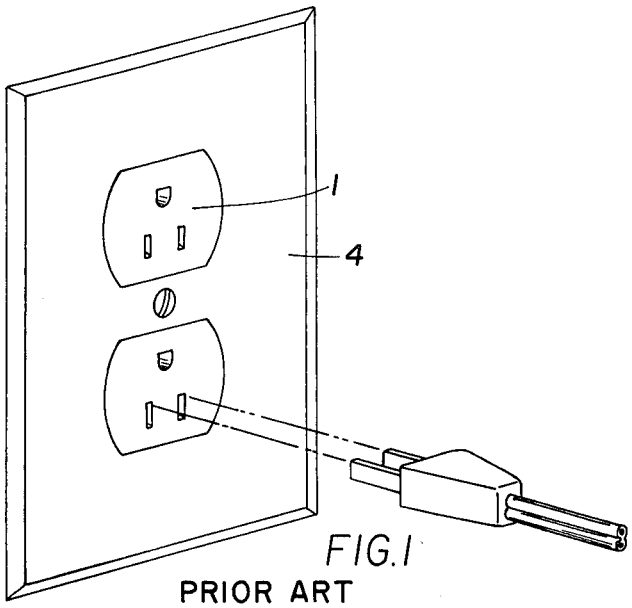
FIG. 1 PRIOR ART
FIG. 1 is a schematic diagram of a wall plate, a wall receptacle and a plug.

The safety device of the invention is for an electrical connector device such as, for example, a wall receptacle 1 (FIGS. 1 and 2), a wall switch 2 (FIG. 4), a rotary control switch 3 (FIG. 5), and so on. The receptacles 1 are mounted in wall plates 4 and 5 (FIGS. 1, 2 and 3) and the wall switch 2 is mounted in a wall plate 6 (FIG. 4).

Figure 3:
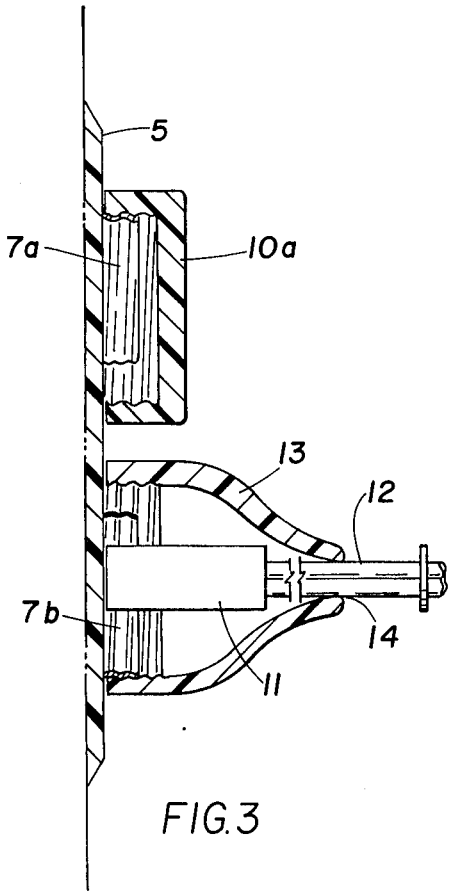
FIG. 3 is a sectional view, taken along the line III—III, of FIG. 2.
Figure 2:
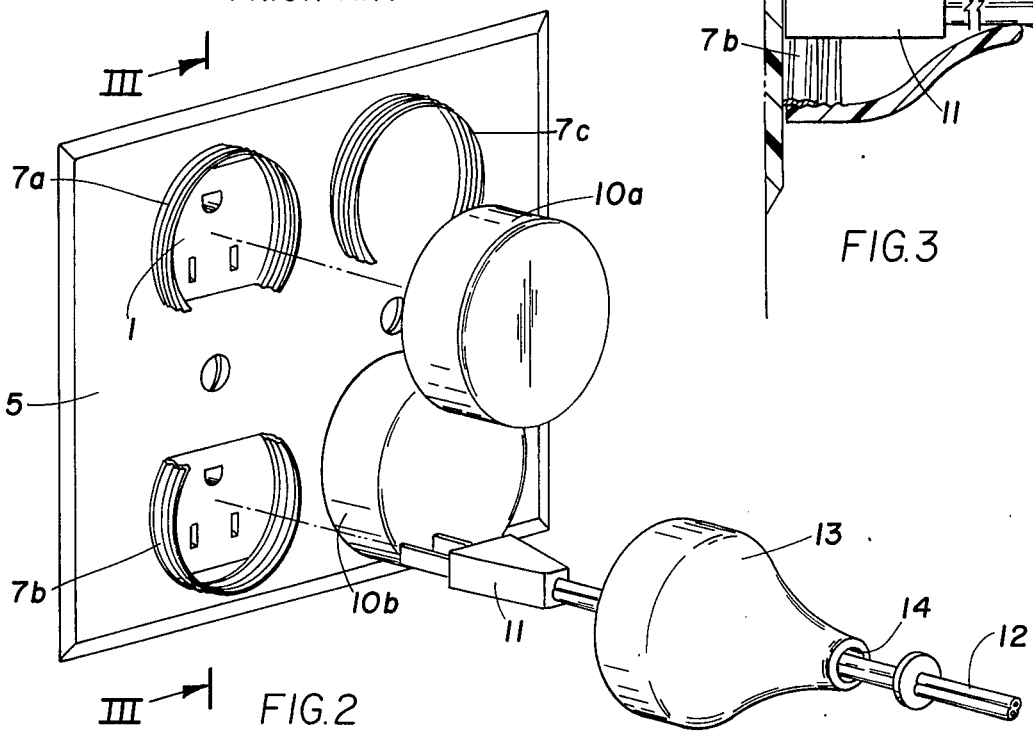
FIG. 2 is a schematic diagram of two embodiments of the safety device of the invention for an electrical connector device.
Figure 4:
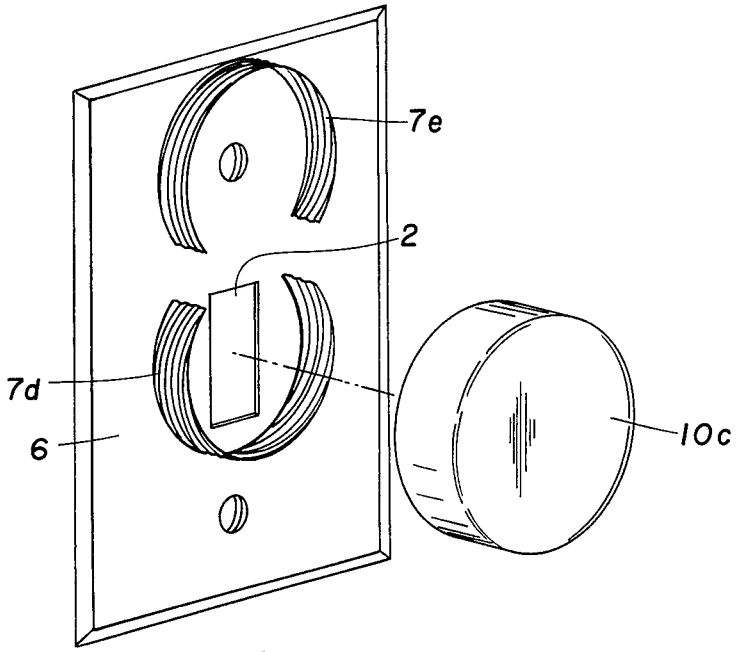
FIG. 4 is a schematic diagram of one of the embodiments of FIG. 2 and a different type of an electrical connector device.
Figure 5:
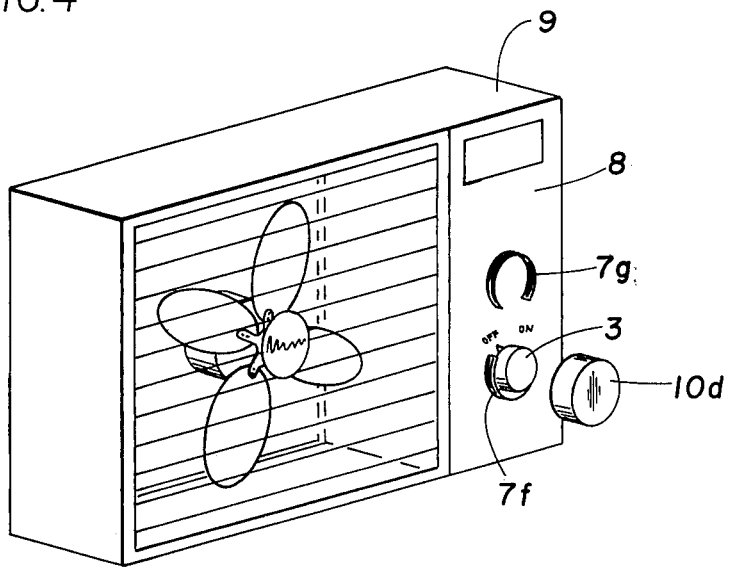
FIG. 5 is a schematic diagram of the embodiment of FIG. 4 and still another type of an electrical connector device.

The safety device of the invention comprises an externally threaded substantially sleeve type device *7a* surrounding at least part of the receptacle 1 and an identical sleeve-type device *7b* surrounding another part of the receptacle 1 (FIGS. 2 and 3). An identical sleeve type device *7c* is affixed to the wall plate 5 (FIG. 2). An externally threaded substantially sleeve-type device *7d* surrounds at least part of the wall switch 2 (FIG. 4). An identical sleeve type device *7e* is affixed to the wall plate 6 (FIG. 4). An externally threaded substantially sleeve type device *7f* surrounds at least part of the rotary control switch 3 (FIG. 5). An identical sleeve type device *7g* is affixed to a surface 8 of a fan unit 9 in the area of the rotary control switch 3 thereof (FIG. 5). The rotary control switch 3 is on the surface 8 of the fan unit 9.

The safety device of the invention further comprises an internally threaded cap 10*a* or 10*b* (FIG. 2), 10*c* (FIG. 4) or 10*d* (FIG. 5), threadedly coupled to the sleeve type device *7a*, *7b*, *7d* or *7f*, respectively, and covering the wall receptacle 1, the switch 2 and the rotary control switch 3, respectively.

The sleeve type device *7a*, *7b*, *7c*, *7d*, *7e*, *7f* or *7g* comprises a substantially hollow cylinder having a cylindrical surface extending approximatly 270° in circumference.

The wall receptacle 1, as shown in FIGS. 2 and 3, accommodates a plug 11 affixed to electrically conductive wires 12. In such case, another embodiment of the safety device of the invention comprises an internally threaded funnel-shaped cap 13 having a substantially axial bore 14 formed therethrough (FIGS. 2 and 3). The wires 12 extend through the bore 14.

The sleeve type devices *7a* to *7g* are mounted on the wall plates 5 and 6 and on the surface 8 (FIGS. 2 to 5). The sleeve type device *7c* is an additional device mounted on the wall plate 5 in spaced relation with the receptacle 1 for supporting the cap 10*a* when the receptacle is in use. The sleeve type devices *7e* and *7g* are also additional devices mounted on the wall plate 6 and on the surface 8 in spaced relation with the switches 2 and 3 for supporting the cap 10*c* or 10*d*, respectively, when the switches are being changed between their ON and OFF positions.

The sleeve type device *7e* is for the purpose of keeping the cap 10*c* handy at all times. When children are home, the cap 10*c* is removed from the sleeve-type device *7e* and is mounted on the sleeve type device *7d*, thereby covering the switch 2 and keeping the children from interfering with the position of the switch. The same applies to the sleeve type device *7g* and the cap 10*d* of the fan unit 9.

When the receptacle 1 is in use, it is plugged in along with the safety cap 13. At such time, the sleeve type device *7c* supports the cap 10*a* and keeps it handy. When the receptacle 1 is not in use, it is not plugged in. The receptacle should thus be closed by taking the handy cap 10*a* from the sleeve type device *7c* and mounting it on the sleeve type device *7a*, thereby covering the receptacle. Thus, in accordance with the invention, the receptacles are covered at all times.

While the invention has been described by means of specific examples and in specific embodiments, I do not wish to be limited thereto, for obvious modifications will occur to those skilled in the art without departing from the spirit and scope of the invention.

I claim:

1. A safety device for an electrical connector device of an electrical wall fixture, said safety device comprising a plate for covering an electrical wall fixture;

a first externally threaded substantially sleeve type device mounted on the plate and surrounding at least part of an electrical connector device of the electrical wall fixture;

a second externally threaded substantially sleeve type device mounted on the plate;

a first internally threaded cap threadedly coupled to the first sleeve type device and covering the electrical connector device when the receptacle is not in use and threadedly coupled to the second sleeve type device when the receptacle is in use; and a second internally threaded cap for accommodating an electrical connector plug and threadedly coupled to the first sleeve type device when the receptacle is in use in cooperation with the electrical connector plug.

2. A safety device as claimed in claim 1, wherein the sleeve type device comprises a substantially hollow cylinder having a cylindrical surface extending approximately 270° in circumference.

3. A safety device as claimed in claim 2, wherein the electrical connector device is a wall receptacle for accommodating an electrical connector plug affixed to electrically conductive wires, and wherein the second cap has a substantially axial bore formed therethrough and the wires extend through the bore, said second cap being funnel shaped and being threadedly coupled to the sleeve type device and accommodating the plug firmly.

4. A safety device for an electrical connector device of an electrical wall switch, said safety device comprising a plate for covering an electrical wall switch;

a first externally threaded substantially sleeve type device mounted on the plate and surrounding at least part of the electrical wall switch, said sleeve type device comprising a substantially hollow cylinder having a cylindrical surface extending approximately 270° in circumference;

a second externally threaded substantially sleeve type device mounted on the plate; and an internally threaded cap threadedly coupled to the first sleeve type device and covering the wall switch when said switch is not in use and threadedly coupled to the second sleeve type device when switch is in use.

* * * * *

UNITED STATES PATENT AND TRADEMARK OFFICE

CERTIFICATE OF CORRECTION

PATENT NO. : 4,076,360

DATED : February 29, 1978

INVENTOR(S) : DHARAM DEV SINGH KAHERA

It is certified that error appears in the above-identified patent and that said Letters Patent are hereby corrected as shown below:

The name of patentee is

DHARAM DEV SINGH KAHERA

Signed and Sealed this

Sixth Day of June 1978

[SEAL]

*Attest:*

RUTH C. MASON
*Attesting Officer*

DONALD W. BANNER
*Commissioner of Patents and Trademarks*